United States Patent [19]

Diep et al.

[11] Patent Number: 4,462,830

[45] Date of Patent: Jul. 31, 1984

[54] CORROSION INHIBITED COPPER NITRATE SOLUTIONS

[75] Inventors: Daniel V. Diep, Aurora; David A. Grattan, Hinsdale, both of Ill.

[73] Assignee: Nalco Chemical Company, Oak Brook, Ill.

[21] Appl. No.: 520,262

[22] Filed: Aug. 4, 1983

[51] Int. Cl.[3] ..... C09D 5/08

[52] U.S. Cl. ..... 106/14.14; 106/14.13; 106/14.15; 106/14.21; 252/387; 422/12

[58] Field of Search ..... 106/14.05, 14.14, 14.13, 106/14.15, 14.17, 14.21; 252/387; 422/12

[56] References Cited

U.S. PATENT DOCUMENTS

| | | | |
|---|---|---|---|
| 3,460,953 | 8/1969 | Schwartz | 106/1.23 |
| 3,716,462 | 2/1973 | Jensen | 106/1.23 |

*Primary Examiner*—Lorenzo B. Hayes

*Attorney, Agent, or Firm*—John G. Premo; Robert A. Miller; Donald G. Epple

[57] ABSTRACT

A non-corrosive aqueous solution of a copper nitrate which contains at least 30% by weight of copper nitrate, from 1-5% by weight of boric acid based on the weight of the copper nitrate, and from 0.2-3.0% by weight of EDTA based on the weight of the copper nitrate.

2 Claims, No Drawings

CORROSION INHIBITED COPPER NITRATE SOLUTIONS

Aqueous copper nitrate is an effective coal combustion catalyst. However, it is extremely corrosive toward mild steel parts of the coal handling system. It was found that EDTA and boric acid exhibited some inhibitory effect when tested at room temperature or at elevated temperatures.

Specifically, the invention provides a non-corrosive solution of copper nitrate which contains at least 30% by weight up to its saturation solubility of copper nitrate and, preferably, 30–52% by weight. This solution also contains from 1–5% and, preferably, 2–5% by weight of boric acid based on the weight of the copper nitrate. Finally, the solution contains from 0.2–3.0% by weight and, preferably, 1–2% by weight of EDTA (ethylenediamine tetra acetic acid).

EXAMPLE

Mild steel coupons of the 1020 type were used as test specimens. The combination of boric acid together with EDTA significantly reduced the corrosion rate of copper nitrate solutions when tested at 140° F. This is shown below:

| Solution Composition | Test Duration and Corrosion Rate | |
|---|---|---|
| | 24 hrs. | 5 days |
| 1. 35.34% $Cu(NO_3)_2$<br>64.66% $H_2O$ | 1170 mpy | 262 mpy |
| 2. 35.34% $Cu(NO_3)_2$<br>1.33% Boric Acid<br>0.4% EDTA<br>62.93% $H_2O$ | 180 mpy | 59 mpy |

Having thus described our invention, we claim:

1. A non-corrosive aqueous solution consisting essentially of at least 30% by weight of copper nitrate, from 1–5% by weight of boric acid based on the weight of the copper nitrate, and from 0.2–3.0% by weight of ethylenediaminetetraacetic acid based on the weight of the copper nitrate.

2. A non-corrosive aqueous solution consisting essentially of at least 30–52% by weight of copper nitrate, from 2–5% by weight of boric acid based on the weight of the copper nitrate, and from 1–2% by weight of ethylenediaminetetraacetic acid based on the weight of the copper nitrate.

* * * * *